US008506467B2

(12) United States Patent
Minnich et al.

(10) Patent No.: US 8,506,467 B2
(45) Date of Patent: Aug. 13, 2013

(54) PROCESS FOR SOLIDIFYING ORGANIC AND INORGANIC PROVISIONAL CONSTITUENTS CONTAINED IN PRODUCED WATER FROM HEAVY OIL OPERATIONS

(75) Inventors: Keith R Minnich, Calgary (CA); David E. Gamache, Oswego, IL (US); John Kus, Calgary (CA)

(73) Assignees: Veolia Water Solutions & Technologies North America, Inc., Moon Township, PA (US); Statoil Canada Ltd., Calgary, Alberta (CA)

( * ) Notice: Subject to any disclaimer, the term of this patent is extended or adjusted under 35 U.S.C. 154(b) by 173 days.

(21) Appl. No.: 13/268,180

(22) Filed: Oct. 7, 2011

(65) Prior Publication Data

US 2012/0087737 A1 Apr. 12, 2012

Related U.S. Application Data

(60) Provisional application No. 61/391,205, filed on Oct. 8, 2010.

(51) Int. Cl.
*E21B 43/00* (2006.01)

(52) U.S. Cl.
USPC ..... 588/252; 588/256

(58) Field of Classification Search
USPC ..... 588/252, 256
See application file for complete search history.

(56) References Cited

U.S. PATENT DOCUMENTS

| | | | | |
|---|---|---|---|---|
| 3,230,282 | A | 1/1966 | Campagne et al. | |
| 5,028,336 | A | 7/1991 | Bartels et al. | |
| 2003/0127226 | A1* | 7/2003 | Heins | 166/303 |
| 2006/0273051 | A1* | 12/2006 | Ivan | 210/788 |
| 2007/0102154 | A1 | 5/2007 | Grott | |
| 2007/0221376 | A1* | 9/2007 | Solomon et al. | 166/266 |
| 2010/0038081 | A1 | 2/2010 | Gamache et al. | |

* cited by examiner

*Primary Examiner* — John Kreck
(74) *Attorney, Agent, or Firm* — Coats and Bennett, PLLC

(57) ABSTRACT

A process is provided for treating produced water recovered from an oil recovery process. An oil-water mixture is collected from an oil bearing formation. The oil-water mixture is directed to a separator that separates the oil-water mixture to yield produced water and an oil product. The produced water includes water, dissolved organics and dissolved inorganic solids. The produced water is directed to a crystallizer. In the crystallizer, the produced water is concentrated by heating the produced water. Concentrating the produced water causes the organic and inorganic solids to precipitate from the produced water and form solid crystals, including salt crystals. Further, concentrating the produced water in the crystallizer produces an organic melt including the solid crystals. Thereafter, the method or process entails cooling the organic melt such that the organic melt solidifies into an organic solid structure, and wherein substantially no free water is present in the organic solid structure.

23 Claims, 4 Drawing Sheets

PROCESS FOR SOLIDIFYING ORGANIC AND INORGANIC PROVISIONAL CONSTITUENTS CONTAINED IN PRODUCED WATER FROM HEAVY OIL OPERATIONS

CROSS-REFERENCE TO RELATED APPLICATIONS

The present application claims priority from provisional U.S. Patent Application Ser. No. 61/391,205 filed Oct. 8, 2010, the content of which is expressly incorporated herein by reference.

FIELD OF INVENTION

The present invention relates to a process for recovering heavy oil and, more particularly, to a process for solidifying inorganic and organic constituents contained in produced water that is a by-product from recovering heavy oil.

SUMMARY OF THE INVENTION

The present invention relates to a process for concentrating produced water with a high concentration of inorganics and organics which are a byproduct of an oil recovery process. The process includes evaporation of the produced water in a crystallizer which is designed to evaporate virtually all free water from the produced water leaving solid crystals suspended in an organic melt. The organic melt from oil operations is a fluid at temperatures above 100° C. Upon cooling the organics freeze to form a solid. The frozen organic solid traps the suspended solid crystals. The organic solid can be cast in place in a landfill.

In one particular embodiment, the present invention entails a method of recovering oil from a SAGD (steam assist gravity drainage) oil well and treating the resulting produced water. The terms "oil" and "heavy oil" includes bitumen. This method or process entails recovering an oil-water mixture from an oil well and separating from the oil-water mixture to yield produced water. The produced water is directed to an evaporator that produces a distillate that is directed to a steam generator that produces steam that is injected into an injection well. The evaporator produces a blowdown stream that is directed to a crystallizer. In the crystallizer, the blowdown is concentrated as water is evaporated from the blowdown. The concentration of the blowdown causes inorganic and organic solids to precipitate from the blowdown and to form an organic melt. The organic melt is cooled to form a solidified structure which is suitable for disposal in a landfill.

The other objects and advantages of the present invention will become apparent and obvious from a study of the following description and the accompanying drawings which are merely illustrative of such an invention.

DETAILED DESCRIPTION OF THE INVENTION

Figure 1:
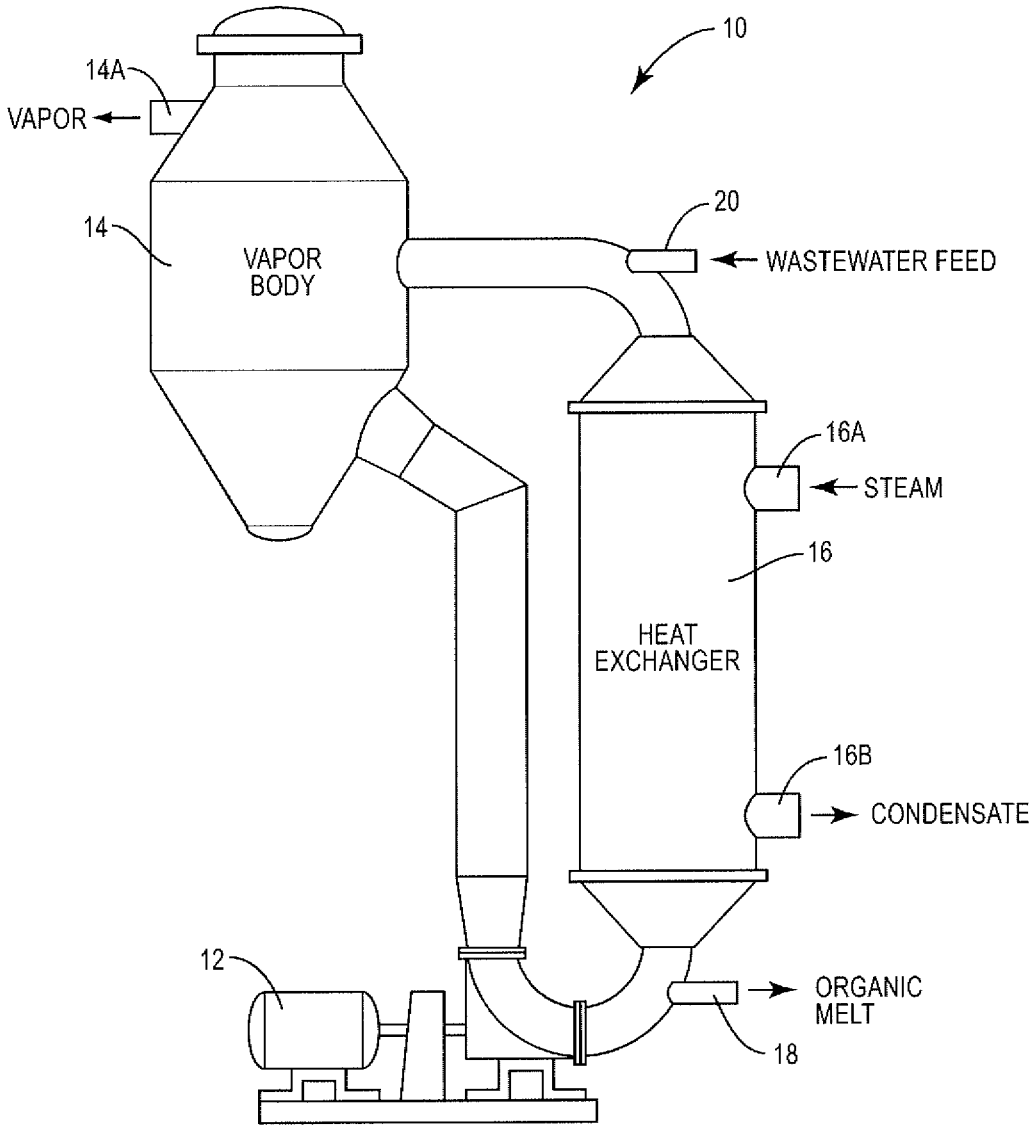
FIG. 1 is a schematic illustration of an exemplary crystallizer used in the process of the present invention.

Conventional oil recovery involves drilling a well and pumping a mixture of oil and water from the well. Oil is separated from the water, and the water is usually injected into a sub-surface formation. Conventional recovery works well for low viscosity oil. However, conventional oil recovery processes do not work well for higher viscosity, or heavy oil.

Enhanced Oil Recovery processes employ thermal methods to improve the recovery of heavy oils from sub-surface reservoirs. The injection of steam into heavy oil bearing formations is a widely practiced enhanced oil recovery method. Typically, several tons of steam are required for each ton of oil recovered. Steam heats the oil in the reservoir, which reduces the viscosity of the oil and allows the oil to flow to a collection well. Steam condenses and mixes with the oil, the condensed steam being called produced water. The mixture of oil and produced water that flows to the collection well is pumped to the surface. Oil is separated from the produced water by conventional processes employed in conventional oil recovery operations.

For economic and environmental reasons it is desirable to recycle the produced water used in steam injection enhanced oil recovery. This is accomplished by treating the produced water, producing a feedwater, and directing the treated feedwater to a steam generator or boiler which produces steam. The complete water cycle includes the steps of:

- injecting the steam into an oil bearing formation,
- condensing the steam to heat the oil whereupon the condensed steam mixes with the oil to form an oil-water mixture,
- collecting the oil-water mixture in a well,
- pumping the oil-water mixture to the surface,
- separating the oil from the oil-water mixture to yield produced water,
- treating the produced water so that it becomes the steam generator or boiler feedwater, and
- converting the feedwater into steam that has a quality suitable for injecting into the oil bearing formation.

There are various methods for treating the produced water to form feedwater for steam generation. One approach is to chemically treat the produced water using various physical/chemical processes. Another approach is to subject the produced water to an evaporation process to produce distillate which is suitable for steam generation feedwater. However, the produced water typically contains significant amounts of silica-based compounds, dissolved organics, sparingly soluble salts, and soluble chloride based salts. These silica-based compounds, dissolved organics, and sparingly soluble salts will tend to foul process surfaces by deposition of silica on the surfaces, hardness scaling, or organic fouling. These scales and fouling layers reduce the thermal conductivity of heat transfer elements in the evaporator equipment and thus reduce the efficiency of heat exchange and steam generation. The chloride based soluble salts will corrode equipment if allowed to accumulate in the system. To prevent or retard scaling, fouling, and corrosion, many water treatment processes remove silica-based compounds, dissolved organics, sparing soluble salts, and soluble chloride based salts in the form of sludge or concentrated wastewater streams. These concentrated wastewater streams are difficult to dispose of in an environmentally safe manner.

The present invention entails a Zero Liquid Discharge (ZLD) process using a ultra high solids crystallizer 10 for heavy oil wastewater treatment wherein inorganic and organic constituents of produced water are converted into a solid for disposal in a landfill. Crystallizer 10 concentrates wastewater with a high fraction of organic solids to a point where virtually all of the free water is removed leaving only solid crystals, such as salt crystals, suspended in an organic melt. Upon cooling the melt solidifies into a material which is suitable for landfill disposal. Fly ash can be added to vary the material handling properties of the melt. Calcium chloride can be added to vary the curing time of the melt.

As discussed above, heavy oil recovery utilizes the heat released from condensing steam to release oil from oil-bearing deposits. The resulting oil-water mixture is collected and pumped to the surface where the oil is separated from the mixture leaving what is called produced water. Produced water is water from underground formations that is brought to the surface during oil production. Herein the term produced water also means waste streams that are derived from produced water during the course of treating produced water. Produced water includes dissolved inorganic solids, dissolved organic compounds, suspended inorganic and organic solids, and dissolved gases. Two examples of SAGD produced water chemistries are shown in Table 1. These produced water compositions are for illustration and not all constituents are listed. In these examples, sodium chloride is the dominant single inorganic constituent. These chemistries have a significant level of Total Organic Carbon (TOC).

TABLE 1

Typical SAGD Produced Water Composition

| Constituent | SAGD Example 1 Produced Water | SAGD Example 2 Produced Water |
|---|---|---|
| Total Solids | 5,700 | 2,800 |
| Na, ppm | 1310 | 321 |
| CL, ppm | 2,060 | 260 |
| TOC, ppm as C | 588 | 596 |
| SiO2, ppm | 170 | 255 |
| SO4, ppm | 41 | 2 |
| HCO3, ppm | 493 | 406 |
| NH4, ppm | 46 | 66 |
| Ca, ppm | 10 | 2 |
| Mg, ppm | 3 | 1 |
| K, ppm | 21 | 18 |

Table 2 shows that the organic matter in these SAGD produced water examples is between 26% and 54% (by weight) of the total solids. In addition to dissolved solids, produced water from heavy oil recovery processes typically includes several hundred ppms of suspended solids. All of the treatment processes which recycle produced water and generate steam produce concentrated wastewater stream(s). All or a portion of these streams must be purged from the system to prevent accumulation of the dissolved organic and inorganic solids in the system. The present invention is directed, then, at methods of treating the wastewater using a crystallizer, preferably an ultra high solids crystallizer, to produce an organic melt with suspended solid crystals such as salt crystals which will solidify upon cooling into a solid which can be disposed in a landfill.

TABLE 2

Primary Categories of Constituents

| Constituent | SAGD Example 1 Produced Water | SAGD Example 2 Produced Water |
|---|---|---|
| NaCl, ppm | 3,400 | 400 |
| Non-NaCl Inorganic solids, ppm | 800 | 900 |
| Estimated Organics, ppm | 1,500 | 1,500 |

Organic matter is typically long chain hydrocarbon molecules derived from bitumen and dissolved in water. The organics are complex and interact with water in different ways depending on their concentration and temperature. For example, when SAGD produced water is concentrated by evaporation of water to a total solids concentration (defined as the sum of dissolved and suspended organic and inorganic solids) of 50% (by weight) at a temperature of approximately 110° C. the liquid portion of the mixture has water like properties. When the mixture is cooled to a temperature of 20° C., the suspended solids settle and the remaining liquid has water like properties. When a SAGD produced water is concentrated by evaporation of water to a total solids concentration (defined as the sum of dissolved and suspended organic and inorganic solids) of 75% to 85% (by weight) at a temperature of approximately 120° C., the liquid portion of the mixture has properties similar to a viscous, asphalt like, semi-solid melt. When the mixture is cooled to a temperature of 20° C. the liquid becomes a semi-solid and there is no apparent free water. The semi-solid becomes a solid with a compressive strength of approximately 3,500 kg/m$^2$ or higher after a period of time which can be several days to several weeks after cooling. In the case of a SAGD produced water waste, the inorganic solids will substantially precipitate after the water is evaporated. The precipitates become suspended in the hydrocarbon semi-solid melt and upon cooling the precipitates are encapsulated in the solidified material. The approximate composition of the solidified melt is shown in Table 3.

TABLE 3

Composition of Solidified Material

| Constituent | SAGD Example 1 Solidified Material | SAGD Example 2 Solidified Material |
|---|---|---|
| NaCl, % of Solidified Melt | 60% | 14% |
| Non-NaCl Inorganic TS, % of Solidified Melt | 13% | 32% |
| Estimated Organics, % of Solidified Melt | 27% | 54% |

Free water is defined as water which is present in liquid form upon cooling of the melt. Expressed in another way, free water means that when the water cools, it becomes a solid. It should be noted, however, that there is approximately 15-25% water still present in the solidified material. Also it should be noted that free water is water which is easily separated from the melt or for example, would pass through a paint filter if a sample of the solidified melt was set on the filter.

Figure 2:
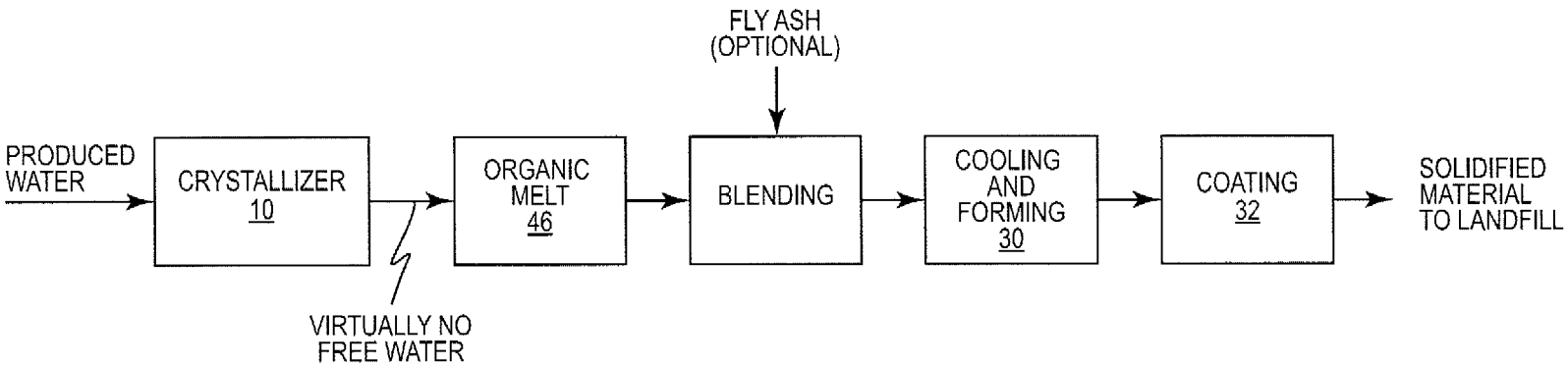
FIG. 2 is a schematic representation of a basic process for a heavy oil recovery process according to the present invention.
Figure 3:
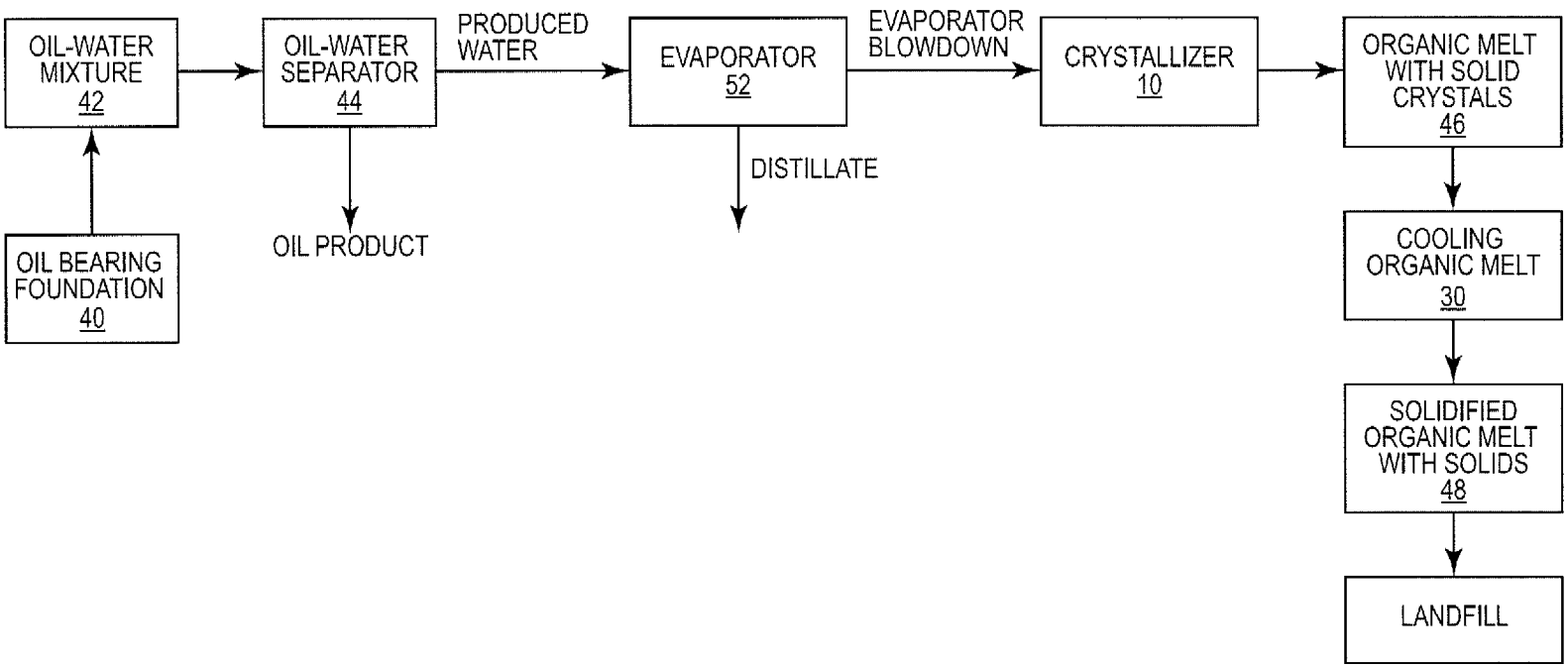
FIG. 3 is a schematic illustration of a heavy oil recovery process showing produced water being treated in accordance with the present invention.
Figure 4:
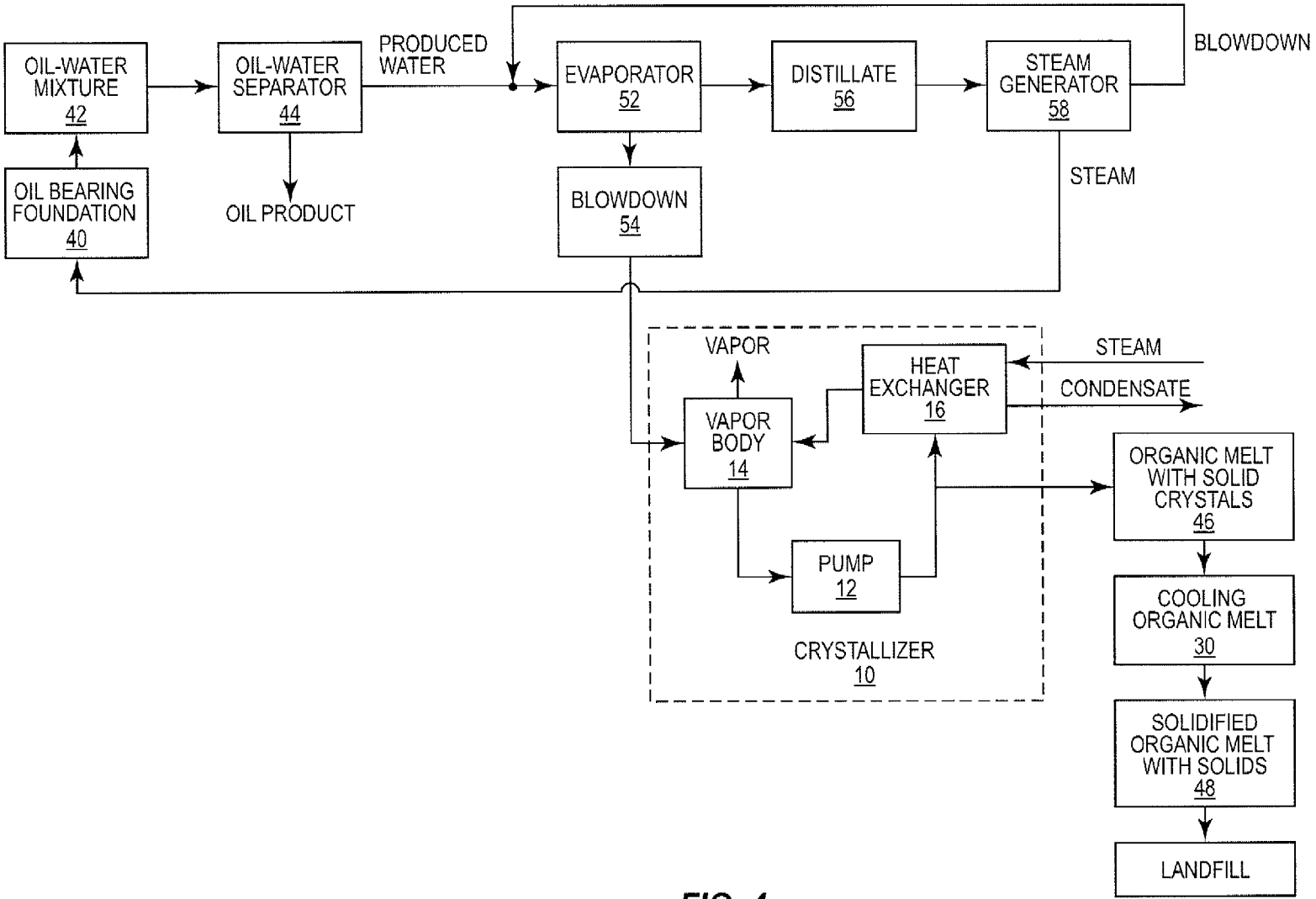
FIG. 4 is a schematic illustration of another heavy oil recovery process showing the blowdown from an evaporator being treated in accordance with the present invention.

Turning now to the general process according to the present invention, the process is depicted schematically in FIGS. 2-4. Wastewater derived from produced water in the heavy oil recovery process including dissolved inorganic solids, dissolved organic compounds, suspended inorganic and organic solids, and dissolved gases is fed to a crystallizer 10. The total solids concentration in the wastewater typically varies between 10% and 30% by weight. However, the crystallizer 10 can be fed with more dilute or concentrated wastewater. Crystallizer 10 can be boiler steam driven or use mechanical vapor compression.

The basic elements of a forced circulation crystallizer 10 are shown in FIG. 1. A recirculation pump 12 draws liquid from a vapor body 14 and pumps the liquid through a heat exchanger 16 and back into the vapor body. Liquid in the vapor body typically has a total solids concentration of approximately 75% (by weight) and a temperature of approximately 115° C. Total solids concentration can typically range between 70% and 85% by weight depending on the relative portions of organic and inorganic materials. The temperature can typically vary between approximately 100° C. and approximately 120° C. when the crystallizer is operated at atmospheric pressure.

Steam is utilized to heat the liquid flowing through the heat exchanger 16. In particular, as viewed in FIG. 1, the heat exchanger 16 includes a steam inlet 16A and a condensate outlet 16B.

Water in the recirculating fluid boils off from the fluid in the vapor body 14. These vapors exit the vapor body 14 via a vapor outlet 14A and flow to a condenser in the case of a boiler steam heated system or to a compressor in the case of a mechanical vapor compression system. A portion of the recirculating fluid is discharged via a product outlet 18 as organic melt. Fresh wastewater is introduced via inlet 20 into the recirculating fluid to replace the organic melt which has been discharged and the fluid that has been vaporized. Typically there is virtually no free water in the recirculating fluid. Free water is defined as water which is present in liquid form upon cooling of the melt. The organic melt is a viscous liquid which can be pumped from the crystallizer to a location where it cools into a solid.

Fly ash can be blended into the melt so that the blend has properties which make it suitable for solids handling equipment. Blending can be performed using a pug mill, which converts the melt into a semi-solid state. The blend can be discharged from the pug mill onto a conveyer belt for transport to the landfill or discharged into a truck for transport to a landfill. The blend can also be extruded into impermeable casings to prevent contact with water. The ratio of fly ash added to the organic melt is typically in a ratio of 1 to 2 or 1 to 1. The time required for the solidified melt to cure from a semi-solid to a solid can be accelerated by the addition of between 0.5% to 4.0% (by weight) calcium chloride. The concentration of total solids in the crystallizer to reach the no free water condition is typically at least 70% by weight. After solidification, the material can be encapsulated in various materials or coated with various materials to prevent leaching if the material comes into contact with water.

FIG. 2 is a schematic that shows a basic process for treating a produced water stream. As discussed above, produced water is directed to the crystallizer 10 which is preferably a high solids crystallizer. Crystallizer 10 produces a concentrate which contains virtually no free water. Adding fly ash to the concentrate is optional. The concentrate is in the form of an organic melt that contains suspended solid crystals including salt crystals. The organic melt produced by the crystallizer 10 typically forms a viscous semi-solid. The viscous semi-solid is subjected to cooling (Block 30). As discussed above, the cooling causes the organic melt to solidify. Thereafter the solidified organic melt can be subjected to a coating process (Block 32) and thereafter the solidified organic melt can be disposed of in a landfill.

FIGS. 3 and 4 show two other oil recovery processes that utilize crystallizer 10 to produce an organic melt. In each case the organic melt is cooled to form a solidified organic melt having suspended solid crystals contained therein.

First, with respect to FIG. 3, oil is located or found in an oil bearing formation (Block 40). Various means can be utilized to recovery oil from the oil bearing formation. As shown in the process of FIG. 4, steam can be injected into an injection well where the steam will ultimately reach the oil and condense to form an oil-water mixture. As shown in FIG. 3, the oil is removed from the oil bearing formation and brought to the surface in the form of an oil-water mixture (Block 42). The oil-water mixture is directed to an oil-water separator (Block 44). The oil-water separator produces an oil product and produced water. The produced water is directed to an evaporator 52 that produces an evaporator blowdown and a distillate. The evaporator blowdown is directed to the crystallizer 10 which heats the evaporator blowdown and vaporizes liquid therefrom. This concentration process will cause dissolved solids and particularly dissolved salts to precipitate from the concentrated liquid. Thus, the precipitants becomes suspended in a hydrocarbon semi-solid melt and during the process these precipitated solids form solid crystals including salt crystals which are suspended in the organic melt (Block 46). Thereafter, the organic melt is subjected to a cooling process (Block 30). Various types of conventional cooling processes can be utilized and as discussed above in one embodiment the organic melt produced by the crystallizer 10 is cooled at a temperature of approximately 20° C. to approximately 30° C. This causes the organic melt to become solidified (Block 48). The solidified organic melt with suspended solid crystals therein can then be placed in a landfill. As discussed above, optionally fly ash and/or calcium chloride can be added to the organic melt prior to cooling.

FIG. 4 is also an oil recovery process and in some respects is similar to the process shown in FIG. 3. The FIG. 4 process however entails an evaporator 52 that is positioned downstream of the oil-water separator 44. Produced water from the oil-water separator is directed to an evaporator 52 that treats the produced water by producing a distillate (Block 56) and a blowdown (Block 54). The distillate is directed to a steam generator (Block 58). The steam generator 58 can be of various types such as a once-through steam generator followed by a steam-water separator or a package boiler. In either case the steam generator produces steam that is injected into an injection well in the vicinity of the oil bearing formation. The steam ultimately reaches the oil and condenses to form the oil-water mixture that is ultimately pumped to the surface for recovery.

In the process shown in FIG. 4, the blowdown from the evaporator 52 is directed to the crystallizer 10. More particularly, the blowdown is directed to the vapor body 14 and from the vapor body the blowdown is pumped through the heat exchanger 16 and heated. The heated blowdown including associated vapor is circulated to the vapor body 14. Produced vapor is directed from the vapor body 14 and the concentrated blowdown is continuously recirculated through the pump 12, heat exchanger 16 and vapor body 14. During this process the crystallizer 10 produces the highly concentrated organic melt having the suspended solid crystals contained in the melt. As discussed above the organic melt is cooled to form a solidified organic melt having the suspended solid crystals contained therein which is suitable for disposal in a landfill.

In the process depicted in FIG. 4, the steam generator (Block 58) will produce a blowdown. Blowdown from the steam generator 58 can be recycled to the evaporator feedwater stream. Further, regeneration waste from various components of the system shown in FIG. 4 can be directed to the crystallizer 10 for further treatment.

In the above specification, from time to time percentage compositions are given. If not particularly set forth, the percentage compositions are always by weight.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A method for treating produced water recovered from a oil recovery process comprising:

collecting an oil-water mixture from an oil bearing formation;

separating oil from the oil-water mixture to yield produced water comprising water, organics, and dissolved solids;

directing the produced water into a crystallizer;

concentrating the produced water by heating the produced water in the crystallizer and removing water from the produced water and producing a vapor and an organic melt containing solid crystals; and cooling the organic melt such that the organic melt solidifies into an organic solid structure containing the solid crystals, and wherein substantially no free water is present in the organic solid structure.

2. The method of claim 1 wherein concentrating the produced water comprises concentrating the produced water to a total solids concentration of 75% to 85% by weight.

3. The method of claim 2 wherein heating the produced water comprises heating the produced water to a temperature of approximately 100° C. to approximately 120° C.

4. The method of claim 3 wherein cooling the organic melt comprises cooling the organic melt to a temperature of approximately 20° C. to approximately 30° C.

5. The method of claim 1 wherein after cooling, the organic solid structure has a compressive strength of approximately 3,500 kg/m$^2$ or higher.

6. The method of claim 1 further comprising blending fly ash into the organic melt prior to forming the organic solid structure.

7. The method of claim 6 wherein blinding fly ash comprises adding fly ash to the organic melt at a ratio of approximately 1 to 2 or 1 to 1.

8. The method of claim 1 wherein the produced water includes a relatively high concentration of sodium chloride relative to the concentration of non-sodium chloride inorganic solids in the produced water, and wherein concentrating the produced water causes the sodium chloride to precipitate from the produced water and form sodium chloride crystals; and wherein after cooling the organic melt, the sodium chloride crystals are contained in the organic solid structure.

9. The method of claim 1 further comprising adding calcium chloride to the organic melt prior to forming the organic solid structure.

10. The method of claim 9 wherein adding calcium chloride comprises adding between 0.5% to 4.0% by weight calcium chloride to the organic melt.

11. The method of claim 1 further comprising coating the organic solid structure.

12. A method of recovering oil from an oil well and treating produced water, comprising:

(a) recovering an oil-water mixture from the oil well;

(b) separating the oil-water mixture to produce an oil product and the produced water that includes dissolved inorganic and organic solids;

(c) concentrating the produced water in an evaporator to produce a distillate and evaporator blowdown wherein the evaporator blowdown includes dissolved inorganic and organic solids;

(d) directing the distillate to a steam generator and producing steam;

(e) injecting the steam into an injection well which gives rise to the oil-water mixture in the oil well; and (f) directing the evaporator blowdown to a crystallizer and (i) concentrating the evaporator blowdown in the crystallizer by heating the evaporator blowdown;

(ii) wherein concentrating the evaporator blowdown forms an organic melt and causes dissolved solids in the evaporator blowdown to precipitate and crystallize to form solid crystals which are suspended in the organic melt; and (iii) solidifying the organic melt by cooling the organic melt resulting in a solidified organic melt having solid crystals suspend therein.

13. The method of claim 12 wherein the solidified organic melt is suitable for disposal in a landfill.

14. The method of claim 12 including concentrating the evaporator blowdown to where the concentrated evaporator blowdown includes a solids concentration of approximately 75% to approximately 85% by weight.

15. The method of claim 12 including heating the evaporator blowdown to a temperature of approximately 100° C. to approximately 120° C.

16. The method of claim 12 further including blending fly ash into the organic melt prior to cooling the organic melt.

17. The method of claim 12 further comprising adding calcium chloride to the organic melt prior to cooling the organic melt.

18. The method of claim 12 further including coating the solidified organic melt.

19. The method of claim 12 including removing substantially all free water from the evaporator blowdown in the crystallizer.

20. The method of claim 12 further including:

(a) concentrating the evaporator blowdown to where the concentrated evaporator blowdown includes a solids concentration of approximately 75% approximately 85% by weight; and (b) concentrating the evaporator blowdown such that substantially all free water from the evaporator blowdown is removed.

21. The method of claim 20 further including heating the evaporator blowdown to a temperature of approximately 100° C. to approximately 120° C.

22. The method of claim 21 further including blending fly ash into the organic melt prior to cooling the organic melt or adding calcium chloride to the organic melt prior to cooling the organic melt.

23. The method of claim 8 wherein the sodium chloride crystals constitute approximately 14% to approximately 16% of the organic solid structure.

* * * * *